United States Patent [19]

Blomgren, Jr. et al.

[11] 4,377,839

[45] Mar. 22, 1983

[54] ENERGY TRANSFER APPARATUS

[75] Inventors: Oscar C. Blomgren, Jr., Lake Forest; Henry A. Renken, Lake Bluff, both of Ill.

[73] Assignee: Inter-Probe, Inc., North Chicago, Ill.

[21] Appl. No.: 282,427

[22] Filed: Jul. 13, 1981

Related U.S. Application Data

[63] Continuation-in-part of Ser. No. 111,610, Jan. 14, 1980, abandoned.

[51] Int. Cl.[3] ..... F24F 3/12; H01T 19/04

[52] U.S. Cl. ..... 361/233; 361/229; 361/230

[58] Field of Search ..... 361/229, 230, 231, 233; 165/2

[56] References Cited

U.S. PATENT DOCUMENTS

| | | | |
|---|---|---|---|
| 1,980,821 | 11/1934 | Palueff . | |
| 2,604,936 | 7/1952 | Kaehni et al. | 361/233 |
| 2,949,550 | 8/1960 | Brown . | |
| 3,018,394 | 1/1962 | Brown . | |
| 3,203,809 | 8/1965 | Visness et al. . | |
| 3,210,007 | 10/1965 | Doyle et al. . | |
| 3,224,497 | 12/1965 | Blomgren, Sr. et al. | 165/2 |
| 3,370,644 | 2/1968 | Daily et al. . | |
| 3,417,267 | 12/1968 | Marks . | |
| 3,418,155 | 12/1968 | Colvin et al. . | |
| 3,573,547 | 4/1971 | Fredrickson | 361/231 |
| 3,670,606 | 6/1972 | Blomgren, Sr. et al. | 82/1 C |
| 3,711,743 | 1/1973 | Bolasny . | |
| 3,717,148 | 2/1973 | Svab | 361/231 X |
| 3,735,175 | 5/1973 | Blomgren, Jr. | 313/60 |
| 3,747,284 | 7/1973 | Lyczko | 51/267 |
| 3,757,079 | 9/1973 | Blomgren, Sr. et al. | 219/137 |
| 3,763,928 | 10/1973 | Fletcher . | |
| 3,794,111 | 2/1974 | Blomgren, Sr. et al. | 165/1 |
| 3,872,917 | 3/1975 | Blomgren, Sr. et al. | 165/1 |
| 3,959,690 | 5/1976 | Leibrecht | 361/230 |
| 4,015,658 | 4/1977 | Kibler et al. . | |
| 4,072,762 | 2/1978 | Rhodes | 426/510 |
| 4,104,696 | 8/1978 | Cochran, Jr. | 361/229 |
| 4,216,518 | 8/1980 | Simons | 361/229 |

FOREIGN PATENT DOCUMENTS

| | | | |
|---|---|---|---|
| 2338488 | 3/1974 | Fed. Rep. of Germany | 361/229 |
| 2538958 | 3/1977 | Fed. Rep. of Germany . | |
| 2650259 | 5/1978 | Fed. Rep. of Germany . | |
| 2854716 | 6/1980 | Fed. Rep. of Germany . | |
| 7204142 | 10/1972 | Netherlands . | |
| 696515 | of 0000 | United Kingdom | 361/229 |

*Primary Examiner*—Reinhard J. Eisenzopf
*Attorney, Agent, or Firm*—Lloyd L. Zickert

[57] ABSTRACT

Apparatus and method for efficiently transferring energy through a medium between a source and a target which in one form includes a rigid frame supporting a plurality of electrically conductive probe strips having probe tips or points spaced therealong and a plurality of connected grid wires or rods in spaced relation to the probe tips or points and electrically insulated therefrom. The grid wires are arranged in at least a pair configuration with respect to each of the probe strips. The probe points are disposed in facing relation toward the target and each grid wire pair is equally disposed in relation to the axis of the probe strip points that it serves. A high voltage low amperage direct current source is connected to the probe strips. In another form the apparatus includes a single probe tip or point in combination with a pair of electrically connected grid wires.

32 Claims, 12 Drawing Figures

FIG. 1
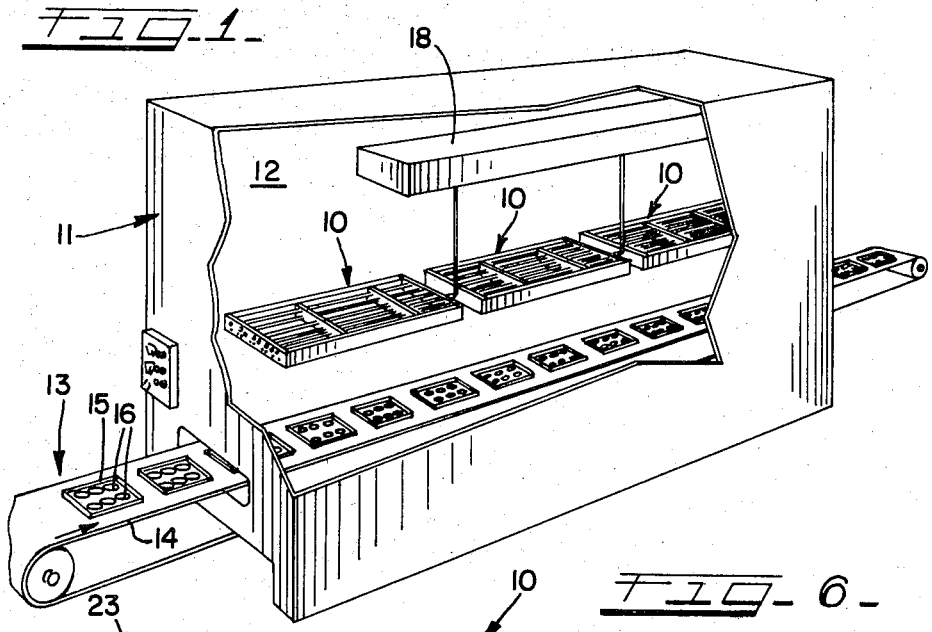
FIG. 6
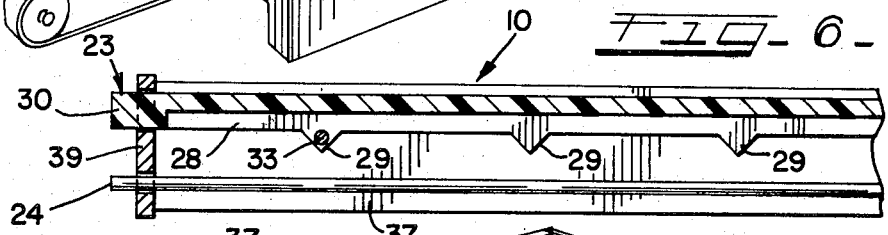
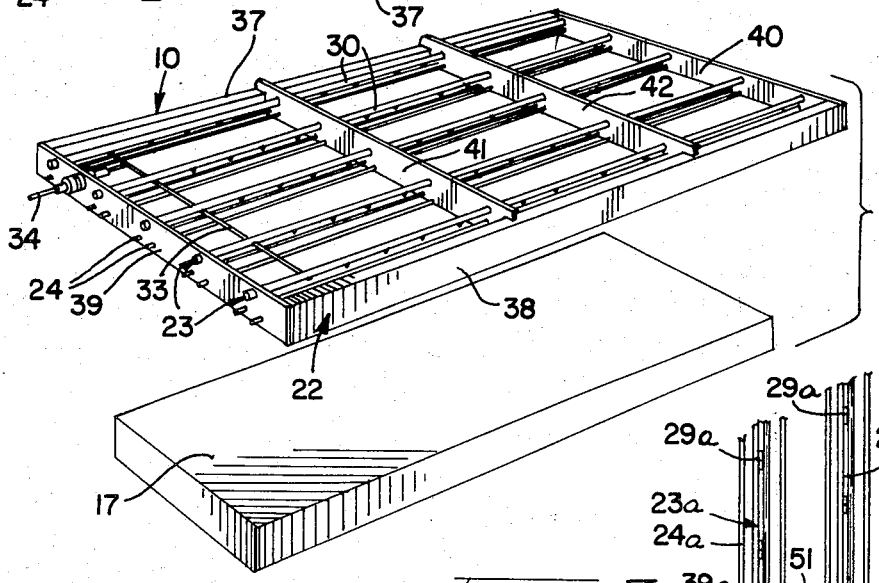
FIG. 2
FIG. 7
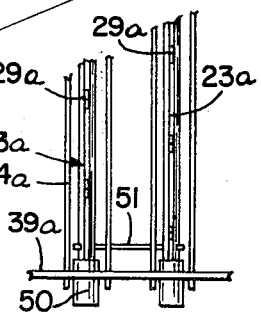

FIG. 8
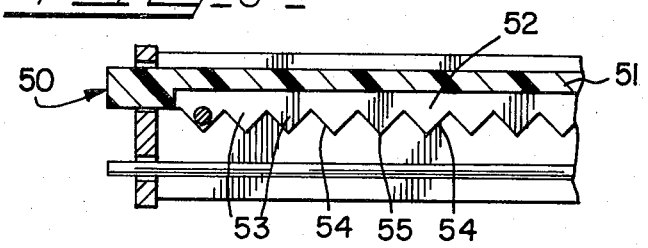
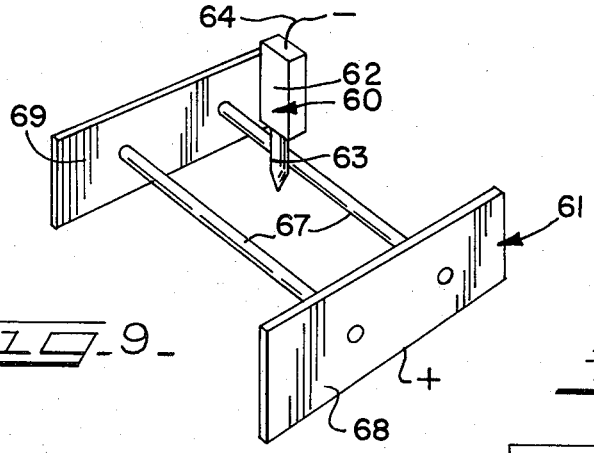
FIG. 9
FIG. 10
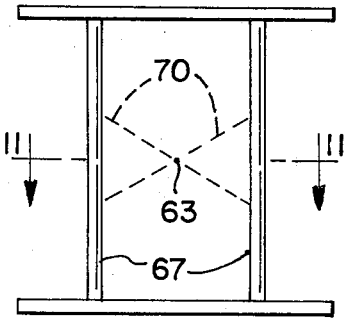
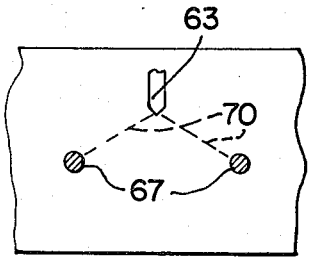
FIG. 11
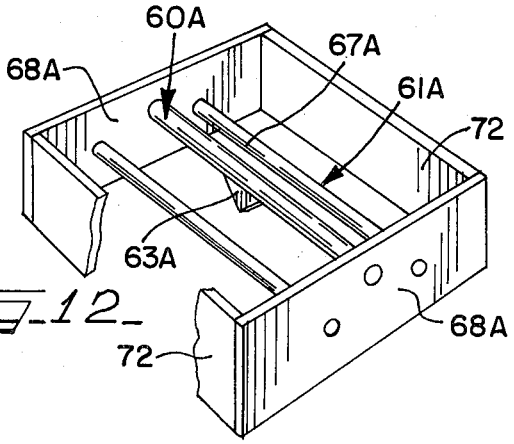
FIG. 12

ENERGY TRANSFER APPARATUS

This is a continuation-in-part application of our application Ser. No. 111,610, filed Jan. 14, 1980, now abandoned.

This invention relates in general to an apparatus and a method for efficiently transferring energy from a source to a target or targets, and more particularly to an apparatus for accelerating the transfer of energy through a medium to a target or targets by use of electrostatic means.

Heretofore, it has been well known to employ electrostatic energy for controlling the energy level in a target object such as disclosed in U.S. Pat. No. 3,224,497, which particularly concerns the reduction in temperature of a target object situated in an ambient atmosphere of a temperature lower than that of the object.

Other patents also teaching the reduction of temperature of target objects through the use of electrostatics include U.S. Pat. Nos. 3,670,606; 3,735,175; 3,747,284; 3,757,079; 3,794,111, and 3,872,917. It has also been proposed to cook food with steam in the presence of electrostatics such as illustrated in U.S. Pat. No. 4,072,762. Likewise, it has been known to enhance the transfer of cold energy to a target through the use of electrostatics.

Where the object being treated with electrostatics is stationary with respect to the apparatus used for creating the electrostatic field and always of the same dimension and disposition with regard to the field emission point or points, a uniform result can be obtained. Similarly, if the objects being subjected to the electrostatic field are moving relative to the apparatus creating the field and the objects are always of the same size so that their spacing from the apparatus creating the field does not vary, a relatively uniform energy transfer can be obtained. However, heretofore, where the objects being subjected to the electrostatic field may be of random shapes and sizes such that some of the objects, when moved through the electrostatic field, may be closer or farther from the apparatus creating the field, uniform energy transfer is not attainable. Indeed, it is nearly impossible to provide efficient energy transfer for irregularly shaped products with hetetofore known high voltage electrostatic field devices. More particularly, heretofore known apparatuses utilized in connection with the cooling or heating of target objects are highly geometrically restricted in that they require a given voltage for providing a given current over a predetermined distance of operation between the apparatus and the target. A further variable is produced by both the ambient and target object temperatures. During the treatment of irregularly shaped products such an apparatus will only be efficient relative to the target objects that randomly pass through the field optimally disposed to the geometric constraints. The results obtained in connection with the use of electrostatics are directly related to and proportional to the current draw of the apparatus. This current draw increases where one product might come closer to the apparatus than another. Indeed, if the product comes too close, arc-over is experienced, which completely negates the energy transfer process.

The apparatus of the present invention is capable of providing an electrostatic field for the transfer of energy in large areas without regard to the normal constraints of geometry between the apparatus and the target object or objects whether the target or targets are to be heated or cooled. More particularly, the apparatus of the invention is unique in that the geometric constraints required for the electrostatic transfer of energy are incorporated within the apparatus.

The apparatus in one form includes a frame of rigid construction supporting a probe assembly and a grid assembly in precise relationship with each other and in a non-critical spaced relation from a target object or objects. The probe assembly includes a plurality of probe points of electrically conductive material and connected to one side of a high voltage low amperage direct current source. The grid assembly includes a plurality of wires or rods arranged in precisely spaced relationship relative to the points and of electrically conductive material and connected to the other side of the source of high voltage low amperage direct current. The grid assembly is electrically insulated from the probe assembly and both assemblies are supported by the frame so that thermal expansion and contraction of the assemblies and the frame are independent of one another, thereby enhancing the precisely established relationship between the probe assembly and the grid assembly. However, the probe assembly need not be supported by the frame supporting the grid assembly. The shape of the apparatus may take any desired form so long as the spacing between the probe assembly and the grid assembly is maintained. Likewise, the apparatus may be utilized in the form of plural mechanically and electrically connected modules for generating the desired electrostatic field in an infinite number of spatial forms.

In another form a single probe point may be associated with a pair of grid wires, but the spatial relation between the probe point and grid wires as above noted must be observed.

It is therefore an object of the present invention to provide a new and improved apparatus and method for generating an electrostatic field to accelerate energy transfer between the energy source and a target or targets which is not dependent upon the precise spacing between the apparatus and the target or targets.

Another object of the present invention is to provide an apparatus for creating a high voltage low amperage direct current electrostatic field between a probe assembly and a grid assembly in precisely spaced apart relationship to accelerate the transfer of energy to a target or targets located non-critically beyond the grid assembly, and which does not depend upon a precise geometric relation between the apparatus and the target or targets for obtaining a uniform transfer of energy to the target.

Still another object of the invention is in the provision of an apparatus for electrostatically transferring energy to a target in a uniform fashion where the target may be of random size, and which is efficient and safe to operate.

Other objects, features and advantages of the invention will be apparent from the following detailed disclosure, taken in conjunction with the accompanying sheets of drawings, wherein like reference numerals refer to like parts, in which:

FIG. 1 is a perspective view of a system for production heating or cooling of a product and which utilizes the apparatus of the invention for effecting electrostatic transfer of energy between an energy source and the target;

FIG. 2 is an enlarged perspective view of the apparatus of the invention and the disposition of the apparatus relative to a target;

FIG. 6 is an enlarged detailed sectional view taken substantially along line 6—6 of FIG. 3;

FIG. 7 is a fragmentary bottom plan view of a modification showing staggered points and metal probe bars with insulators at their ends for insulating the bars from the frame;

FIG. 8 is a view similar to FIG. 6 of a modified probe assembly where the probe points are directly adjacent to each other;

FIG. 9 is a diagrammatic perspective view of a modification of the module illustrated in FIGS. 1 to 7 wherein only a single pointed probe is utilized with a pair of grid wires or bars;

FIG. 10 is a top plan view of the grid bar assembly of FIG. 9 with the probe removed except for the point to illustrate the pyramidal shape of the effect generated by the point with the grid wires when the module is energized;

FIG. 11 is a generally transverse sectional view of the assembly of FIG. 10 but only partially showing the probe point and to illustrate that the effect created through the medium from the probe point is equal to both grid bars; and FIG. 12 is a view of a proposed assemblage of the probe and grid assemblies which incorporates the single junction as illustrated diagrammatically in FIGS. 9 to 11.

Figure 3:
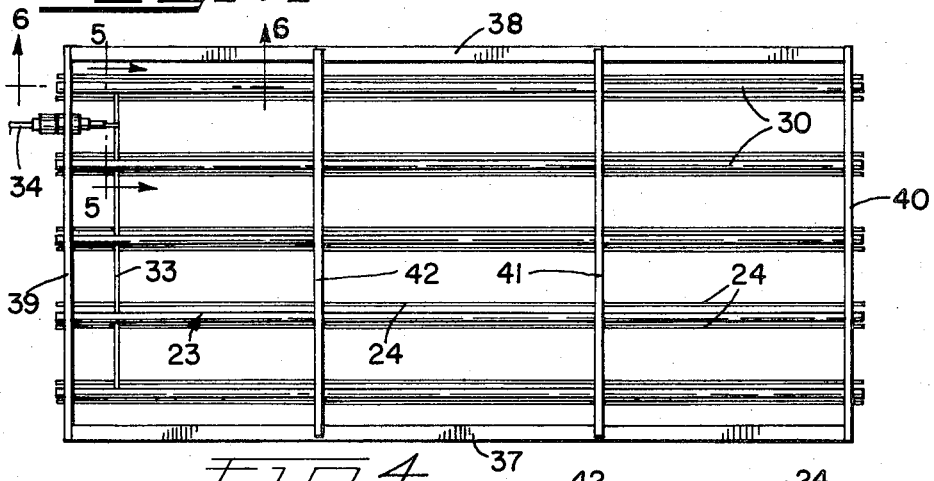
FIG. 3 is a top plan view of the apparatus shown in FIG. 2.

Referring now to the drawings and particularly to FIG. 1, the apparatus of the invention is illustrated in connection with a housing through which goods are transported for being heated or cooled as desired, but it should be appreciated the invention could be used in any dielectric fluid medium for accelerating the transfer of energy from a source to a target. The apparatus in the form of a module is illustrated and generally designated by the numeral 10 in mounted relation within a housing 11 collectively constituting a grid assembly and being electrically insulated from the probe assembly. While the frame is illustrated in rectangular form and arranging the probe bars and grid wires so that the probe bars are in one flat plane and the grid wires in another flat plane parallel thereto, it should be appreciated that the frame might be of an arcuate configuration where the probe bars would be arranged in one arcuate plane and the grid wires arranged in another arcuate plane concentric to the first plane.

Each probe bar 23 includes a probe strip 28 of electrically conductive material having formed therealong probe tips or points 29 in spaced apart relation and carried by a support portion 30 of electrically insulating material. The probe strip 28 may be made of any suitable electrically conductive material such as stainless steel or the like and preferably stainless steel where the apparatus is used in connection with the treatment of food products or in a corrosive atmosphere. The ends of the strips 28, when mounted in the insulating support 30, are spaced from the frame such as to prevent arcing therebetween. The probe support portion 30 would preferably be made of an electrically insulating material, such as Teflon (synthetic resin based on tetrafluorethylene polymers), or a polyvinyl chloride (PVC) material. Where the atmosphere in which the apparatus is to be used would be of a high temperature, such as where baking of a food product would be involved, Teflon would be the desired material which can withstand temperatures defining an enclosed chamber 12. A conveyor 13 having an endless conveyer belt 14 is associated with the housing 11 to transport goods through the housing, whereupon the goods are treated with or subjected to a suitable energy during the time they are within the housing. A plurality of modules 10 are arranged above the conveyor belt 14 on which trays 15 holding product 16 are supported. The trays of product constitute the target toward which the energy is directed. For purposes of simplicity, the target is illustrated in FIG. 2 in the form of a block and designated by the numeral 17. A source of energy 18 is also arranged within the chamber 12 of the housing 11. It will be appreciated that the source of energy may produce heat if it is that type of energy that is desired to be imparted to the target or cold such as by any refrigerated process if it is desired to cool and/or freeze the product. The heat may be used in the case of a food product where it is desired to bake or cook the product, while the cold may be utilized for freezing or drying a product prior to storage for preserving the product. It is also understood that the heat might also be used to soften or otherwise physically change the product, while the cold might be used to harden or otherwise physically change the product.

The electrostatic apparatus 10 includes generally a frame 22 of electrically conductive material supporting a plurality of probe bars 23, collectively constituting a probe assembly, and a plurality of grid wires or rods 24, which can withstand a temperature up to about 500 degrees F. If the atmosphere is of a freezing temperature, the probe bars could be made of PVC which can withstand a temperature up to about 300 degrees F. and is relatively stable at subzero temperatures. Should the apparatus be used in extremely high temperature environments, such as those above 500 degrees F., it might necessitate insulating the metal probe strip with suitable ceramic, glass or other suitable dielectric.

The grid wires 24 are made of any suitable electrically conductive material, and in the event the apparatus is to be used for food products, it would then be most desirable to make the wires of an appropriate grade of stainless steel. Likewise, the frame 22 would be made of a rigid material and preferably of metal, such as stainless steel, whereby the frame would be effectively electrically connected to all of the grid wires 24 but electrically insulated from the probe strips 28 by virtue of the probe strip support portions 30 being made of an electrical insulating material.

The probe strips 28 are suitably electrically connected together, such as illustrated by a bus bar or conductor 33, which extends between and in electrical contact with the probe strips 28.

Figure 4:
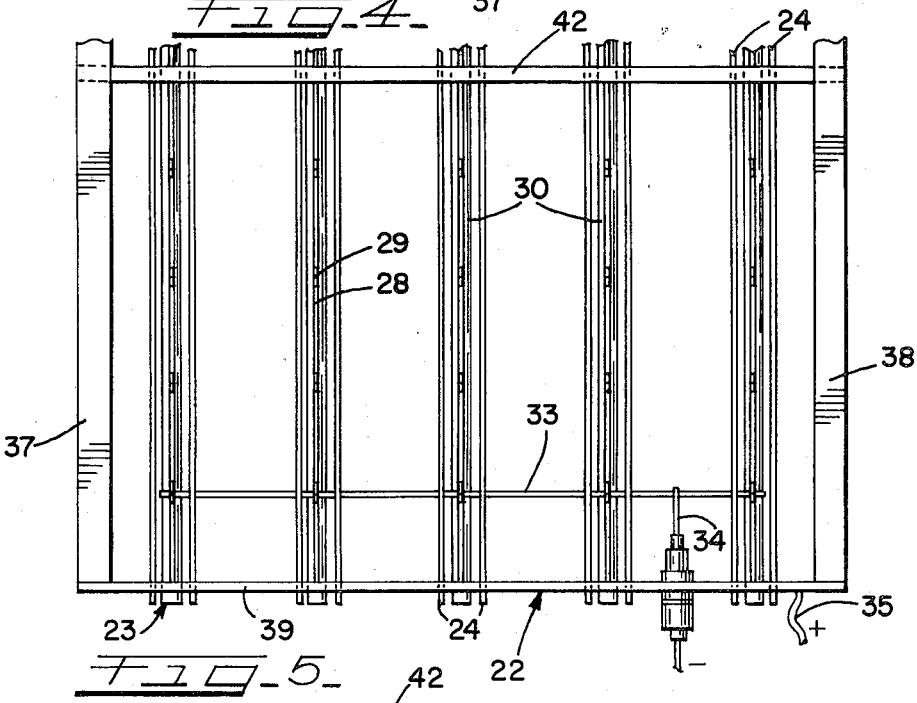
FIG. 4 is a still further enlarged partially fragmentary bottom plan view of the apparatus of FIGS. 2 and 3.

A high voltage low amperage direct current source is connected between the probe strips and grid wires in any suitable manner. As illustrated particularly in FIG. 4, the bus bar 33 is connected to a conductor 34 supported by the frame 22 and in electrical insulation therefrom, while a conductor 35 connected to the frame 22 is also provided for connection to the ground side of the direct current source. Thus, one side of the direct current source is connected to the conductor 34, while the other side is connected to the conductor lead 35, thereby connecting the high voltage low amperage direct current source across the probe strips and the grid wires through the spatial gap provided therebetween.

The frame 22 includes opposed side members 37 and 38 and opposed end members 39 and 40. As illustrated particularly in FIGS. 2 and 6, the opposite ends of the probe bars 23 are received in holes formed in the opposed end members 39 and 40. The fit of the probe bars in the holes is such as to provide slip or sliding movement between the probe bars and the frame such that the probe bars can expand and contract independently of the frame and independently of each other to maintain their spatial relationship with the grid wires. Likewise, the opposite ends of the grid wires are received in holes formed in the opposed frame end members 39 and 40 in a slip or sliding relationship such that the grid wires can thermally expand or contract independently of each other, independently of the frame, and independently of the probe bars 23, thereby eliminating any possibility of change in the spatial relationship between the probe bars and particularly the probe points 29 and the grid wires 24.

Figure 5:
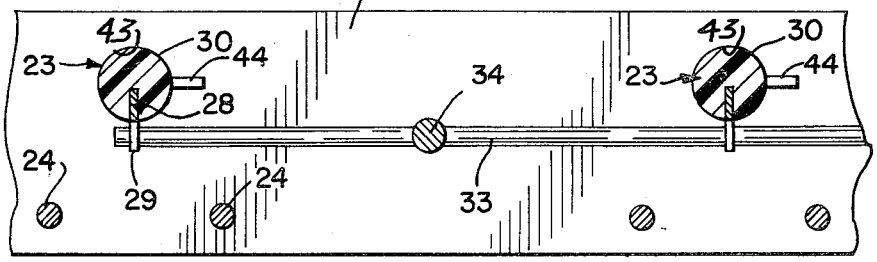
FIG. 5 is a still further enlarged detailed sectional view taken substantially along line 5—5 of FIG. 3.

Additionally, because of the length of the frame and where needed, intermediate support members 41 and 42 are provided to assist in maintaining the desired spatial relationship between the probe points and the grid wires. It can be appreciated that holes 43 are provided in the support members 41 and 42 through which the probe bars and grid wires are received. Further, the support members must be made of electrically insulating material, such as Teflon or PVC, to assure the electrical insulating relationship between the probe strips and the grid wires. Any number of support members may be provided. The openings in the support members as well as the frame end members for the probe bars are such that the probe bars may be inserted through the openings during assembly. In this respect, the holes 43 in the support members 41 and 42, in addition to having a cylindrical configuration, would be provided with a slot 44 through which the probe points could move, after which the probe bars would be rotated and locked in position, as seen in FIG. 5.

While the probe strips 28 would effectively be frictionally held by the probe bars 30, and in this respect a slot could be provided in the probe bars into which the probe strip would be inserted, it can be appreciated that the fit between the probe strips and the probe bars would be such as to allow independent thermal expansion and contraction of the strips relative to the bar supports.

Although the points 29 on the probe strips are triangular in form, and it is believed that as such they may provide the most efficient structure, it can be appreciated that they may take any desired form. Further, the points may vary in number and need not be but are preferably equally spaced along the strip so that uniform operation of the apparatus is obtained throughout its entire length. Additionally, the probe bars are equally spaced apart across the frame for purposes of defining a uniform field, but they may be otherwise spaced if so desired and required by a particular installation. Any number of probe bars and grid pairs may be used in a single frame, this depending upon the amount of area desired to be affected by the apparatus and the current capacity of the high voltage source.

The grid wires 24 are illustrated as being in pairs with respect to each of the probe bars. It should be understood that it is necessary to have at least two grid wires in association with each probe strip but that additional grid wires may be provided if desired. More particularly, the geometric relation between the grid wires and the probe points is critical. Particularly, it is important that the spacing between each grid wire and the points associated therewith be identical along their entire length. Additionally, it is important that the points be positioned centrally between a pair of grid wires, all as illustrated particularly in FIG. 5. Thus, it can be appreciated that in order to maintain the proper spatial relationship between the probe points 29 and the grid wires 24, it is important to allow independent thermal expansion and contraction of the grid wires and the probe strips.

Depending on the atmosphere within which the apparatus is operating, the spatial relationship between the grid wires and probe points will vary for a given high voltage source. For example, the spatial relationship for refrigerated and/or low humidity and/or electrically stable atmospheres, one spatial relationship could be used. A greater spatial relationship would be needed for ambient atmospheres with average or normal humidity and conductivity conditions. A still greater spatial relationship would be needed for heated and/or high humidity and/or electrically unstable atmospheres. Thus, the apparatus may be constructed with an adjustment feature to vary the spatial relationship, such as providing plural pairs of holes for receiving the grid wires. Alternatively, the voltage may be varied and lowered appropriately when greater spatial relationships are needed.

The apparatus herein is set forth as being constructed of preferred materials. The frame, probe bars and grid wires are metal and electrically conductive, while the probe bar supports are of electrically insulating material. Alternately, it could be appreciated the probe bars and their supports, together with the grid wires, could be made of electrically conductive material, while the frame could be made of electrically insulating material to insulate the bars from the wires, and were the grid wires would then be electrically connected by a bus bar. Further, the frame could be made of electrically conductive material and provided with insulators to receive the electrically conductive bars and supports therefor and wires to again electrically insulate the bars from the wires.

In operation of the apparatus of the present invention, the source of high voltage low amperage direct current is preferably connected to the apparatus, whereby the negative side is connected to the probe points 29 and the positive ground side is connected to the grid wires 24. However, the polarity may be reversed, but it has been determined that the best possible results are obtained when the probe points are negative and the grid wires are positive.

For a given module such as that illustrated in FIG. 2, while five rows of probe points are shown with accompanying grid wires, it can be appreciated that any number of rows of probe points may be used with accompanying grid wires in order to obtain the area coverage desired, providing the distance between the rows of probe points is greater than the distance between the probe points and the grid wires. Further, the length of the probe bars will depend upon the length desired and the capacity desired of the unit.

Where a number of modules are employed, such as illustrated in FIG. 1, each can have its own high voltage low amperage direct current source. A typical source would produce between 20,000 and 30,000 volts and not more than seven milliamperes. The effect desired of the module can be regulated by the voltage source, it being appreciated that the energy transfer increases with an increased voltage and current. For example, a 30,000 volt source would produce a greater energy transfer effect than a 20,000 volt source providing the distance from the probe points to grid wires is great enough to prevent arcing. In this respect, where it may be desired to vary the capacity of a unit, such can easily be accomplished by having a varying source of voltage regulatable up or down within a desired range. Higher voltages than those specified may be used with suitable adjustments in the spatial relationship between the probe strips and grid pairs.

It can be appreciated that the apparatus of the invention has no moving parts to wear and would have a zero noise level because of no moving parts. It is also compact and occupies a minimum of space in that it requires a relatively shallow depth and therefore enhances the efficiency of any system in which it is employed. The module is entirely safe when operating below the dangerous level of 30,000 volts and 7 milliamps. Indeed, a person could place his hand below the grid or between the grid and the target without experiencing any hazard. This cannot be done with the type of apparatus disclosed in the above identified U.S. Pat. Nos. 3,224,497 and 4,072,762.

A highly charged field is generated between the apparatus and the target. The positively charged grid accelerates the movement of the negative ions coming from the probe points. When in operation, in addition to causing the movement of air through the apparatus toward the target in the direction from the points to the grid wires, the electrostatic field produces an effect on the target to enhance energy transfer. The field destroys the insulating boundary layer of the target. Thus, the apparatus of the invention greatly accelerates the movement of the ambient atmosphere within which it operates toward the target which is of a temperature above or below the ambient temperature and the negative charge enhances energy transfer. Any number of modules may be utilized together in end-to-end or side-by-side relationship in order to provide the desired effect for a particular system. It is therefore appreciated that the apparatus and method of the present invention is unique and useful for accomplishing the efficient transfer of energy to a target.

In a laboratory setup, a module according to the invention was tested for baking a cake. The module was designed to provide an effective electrostatic area of about one square foot and was fifteen inches by sixteen inches and three inches high. Four parallel probe bars equally spaced three inches apart and a pair of stainless steel grid wires or rods for each bar were supported by and electrically connected to a rectangular electrically conductive frame. The grid wires of each pair were spaced three-fourths of an inch apart. The probe bars were stainless steel and electrically insulated from the frame by the insulators at their ends. The distance between the probe tips and the top edges of the grid wires of each pair was one-and-one-fourth inches.

The module was mounted in a 1600 watt laboratory oven having a 2.66 cubic foot baking area and automatic controls to maintain a preset internal temperature. The module was spaced three inches from the ceiling and a perforated stainless steel shelf was mounted three inches below the module onto which the product to be baked was supported.

Two cake batters were prepared from two boxes of Betty Crocker Stir 'n Frost yellow cake mixes and placed in aluminum foil pans seven inches square by one-and-one-half inches deep. The cakes were separately baked, one with the module de-energized and the other with it energized from a 24 KV, 1.4 ma, 33.6 watt source.

One cake was baked with the module de-energized and the temperature set at 360 degrees F. Baking time was 32 minutes. The other cake was baked with the module energized and the temperature set at 355 degrees F. Baking time was 19 minutes, reducing baking time 40.6 percent.

A modification is illustrated in FIG. 7 which differs in that the points on the probe bars are staggered, the probe bars are made of metal and provided with end insulators to insulate the bars from the frame, and a snap-on bus bar is utilized for electrically interconnecting the probe bars. More specifically, the probe bars of this embodiment are designated by the numeral 23*a* and are made of a suitable electrically conductive metal. End insulators 50 of a suitable electrical insulating material, such as PVC or Teflon, are fitted onto the ends of the probe bars and then in turn received by the end frame members 39*a* in openings provided in the members, thereby electrically insulating the probe bars from the frame which carries the grid rods or bars 24*a*. The grid bars for each probe bar are electrically interconnected by the frame members 39*a* and are of an electrically conductive metal, while, as already mentioned, the electrically conductive probe bars 23*a* are electrically insulated from the frame end members 39*a* by the insulators 50. The insulators 50 accept the probe bars 23*a* in such a way that they may thermally expand or contract without disturbing the geometry of the module. In order to electrically interconnect the probe bars, a snap-on bus bar strip 51 is provided which is clipped onto the outer end probe bars and fitted over and under adjacent probe bars so that it is in electrical contact with all of the probe bars. Then, of course, the power is fed to a single probe bar and effectively to all of the probe bars through the bus bar 51. Finally, the points 29*a* on the probe bars 23*a* are positioned so that crosswise of the module the points will be arranged in staggered relation and not aligned like the embodiment shown in FIG. 4.

A modified probe bar is shown in FIG. 8 and generally designated by the numeral 50, which differs from the probe bar 23 only in the spacing of the probe points. The probe bar 50 includes a support 51 of a suitable electrically insulating material and of the same type as the support portion 30 of the probe bar 23 and suitably fitted thereto a probe strip 52 having a saw-toothed edge defining a plurality of probe points 53 protruding from the support 51. It has been determined that optimum operation of the module of the present invention has been obtained where the probe points are spaced as close together as possible. In this embodiment they are spaced directly adjacent one another. Further, it is important that the probe points are symmetrically formed in that each point includes a pair of edges 54 coming together at a point 55 where the included angle 56 between the edges 54 is ninety degrees, and the included angles between the edges and a line perpendicular to a plane extend through the wires are equal. Further, the probe strip extends parallel to the wires and the points are equally spaced from both wires. This arrangement of the probe points provides optimum operation for moving the medium in which the assembly is mounted. For example, where the assembly is mounted in air, optimum air movement is accomplished with this type of probe bar.

It should also be appreciated that the module of the present invention may be useful in certain applications as a single unit where only a single probe point is associated with a pair of grid wires or rods. This type of embodiment is illustrated in FIGS. 9 to 12 and therefore differs from the embodiment of FIGS. 1 to 6 in that only a single probe point is utilized which, together with the grid bars, forms a single junction. It should be recognized that the module 10 in FIG. 2 incorporates a plurality of junctions.

The embodiment of FIGS. 9 to 11 includes a probe assembly 60 and a grid wire or rod assembly 61. The probe assembly 60 has a body 62 of suitable electrical insulating material supporting an electrically conductive probe point 63 situated with respect to the grid wire assembly 61. A conductor or lead 64 extending from the probe assembly 60 is connected to the high voltage supply and preferably to the negative side as illustrated.

The grid wire assembly 61 includes a pair of grid wires or rods 67 supported and electrically connected at opposite ends by conductive plates 68 and 69 which are connected to the other side of the high voltage supply and preferably to the positive side. As seen in FIGS. 10 and 11, the probe point 63 is situated above the grid wires and equally spaced from each. Any suitable means may be provided to mount the probe assembly relative the grid wire assembly so long as they are electrically insulated from one another.

During operation, the junction established by this embodiment serves to couple to the medium in which the junction is located to effect energy transfer of the conditioned medium to a target. The medium between the probe point 63 and the grid bars is ionized, but the potential of the high voltage source is such as to avoid the breakdown of the medium such that an arc would form between the probe point and the grid wires. The effect created by the probe point is illustrated in FIGS. 10 and 11 wherein it is identified by the numeral 70 such that looking at it in FIG. 10 shows it to be pyramidal in shape. It has been found that an electrical glow discharge of this shape is established during operation of the junction which causes the electric field gradient between the probe point and the grid wires to alternately transverse the media between the grid wires. A continual transversing of the glow discharge between the grid wires thereby covers the area affected such that the discharge generates a potential difference sufficient to ionize the gas or media but is less in intensity which would cause breakdown in arcing. As a single junction the assembly is a high voltage, high power factor, low current device. It provides a constant ground plane aspect ratio that eliminates the necessity of continuous electric field adjustments. The plural junction units of FIGS. 1 to 8 operate in the same manner in that a glow discharge is established at each probe point.

The modification of FIG. 12 only differs from that of FIGS. 8 to 11 in that the probe bar 60A is mounted on the same frame as the grid wire assembly 61A. Moreover, the probe assembly 60A is of a structure similar to that of the probe bar 23 in the embodiment of FIGS. 1 to 7 such that it is electrically insulated from the end supporting plates 68A which are interconnected by side plates 72. Again, the probe assembly 60A would include a single probe point 63A which is equally spaced from the grid wires 67A. This spacing is critical in order to obtain the proper operation of the junction.

It will be understood that modifications and variations may be effected without departing from the scope of the novel concepts of the present invention, but it is understood that this application is to be limited only by the scope of the appended claims.

The invention is hereby claimed as follows:

1. Apparatus for effecting electrostatic transfer of energy to a target comprising, an elongated probe strip of electrically conductive material having a plurality of spaced apart points therealong facing the target, at least two elongated spaced apart grid wires of electrically conductive material in spaced relation to said points and electrically insulated therefrom, said wires being arranged symmetrically to the points and of equal spacing therefrom and disposed between the points and the target, means for supporting said probe strip and grid wires in electrically insulated relationship from each other and to permit independent expansion and contraction of the probe strip and wires, and a source of high voltage low amperage direct current connected across the probe strip and grid wires.

2. Apparatus as defined in claim 1, wherein said probe strip is linear and said grid wires extend parallel thereto.

3. Apparatus as defined in claim 2, which further includes additional sets of probe strips and grid wires arranged in a common plane.

4. Apparatus as defined in claim 3, wherein the high voltage low amperage direct current source is at least 20,000 volts.

5. Apparatus as defined in claim 1, wherein the probe strip is connected to the negative side of the source.

6. Apparatus as defined in claim 1, wherein said support means includes a frame receiving the probe strip and grid wires so that expansion and contraction between the probe strip and grid wires can take place without changing the spatial relationship between the probe strip and the grid wires.

7. Apparatus as defined in claim 6, wherein the frame is electrically conductive and in electrical connection with the grid wires, and an electrically insulating member is provided for supporting the probe strip and is received by said frame.

8. Apparatus for effecting electrostatic transfer of energy to a target comprising, a plurality of electrically conductive longitudinally spaced apart points facing the target, means electrically connecting said points together, at least two elongated spaced apart grid wires of electrically conductive material in spaced relation to said points and electrically insulated therefrom, said grid wires being arranged symmetrically to the points and of equal spacing therefrom and disposed between the points and the target, means for supporting said points and grid wires in electrically insulated relationship from each other and to permit independent expansion and contraction of the points and grid wires, and a source of high voltage low amperage direct current connected across the points and grid wires.

9. Apparatus for electrostatically accelerating the transfer of energy from an energy source to a target wherein the apparatus is in spaced relation from the target, said apparatus comprising a plurality of spaced apart electrically conductive probe strips, each strip including a plurality of spaced apart pointed projections in facing relation to the target, a plurality of grid wires of electrically conductive material arranged between the probe strip points and the target, said grid wires including at least one pair associated with each probe strip, said grid wires of each pair being equally spaced apart and equally spaced from said probe strip points, means for supporting said probe strips relative said grid wires in electrically insulated relationship from each other and to permit independent expansion and contraction between the probe strips and grid wires, and a source of high voltage low amperage direct current connected between the probe strips and grid wires.

10. Apparatus as defined in claim 9, wherein said support means includes a frame receiving said probe strips and grid wires such that the probe strips and grid wires can expand and contract independent of each other and the frame.

11. Apparatus as defined in claim 9, wherein the probe strips and grid wires are in parallel planes.

12. Apparatus as defined in claim 9, wherein the direct current source is generally between twenty and thirty thousand volts.

13. Apparatus as defined in claim 12, wherein the probe strips are connected to the negative side of the source.

14. Apparatus for effecting electrostatic transfer of energy to a target or targets comprising, a frame of rigid material adapted to be in spaced relationship to the target, a plurality of elongated probe bars of rigid material mounted on the frame so that the bars can expand and contract independent of one another and the frame, a probe strip of electrically conductive material having a plurality of spaced apart points therealong facing the target being supported by each of said probe bars so that the strips can expand and contract independent of said bars, at least two grid wires in precisely spaced relation with each probe strip and being disposed between the probe strip and the target, said grid wires being supported by the frame so that the wires can expand and contract independent of each other and the frame, means electrically insulating said probe strips from said grid wires, and a source of high voltage low amperage direct current connected across the probe strips and grid wires.

15. Apparatus as defined in claim 14, wherein said grid wires are equally spaced from the probe points.

16. Apparatus as defined in claim 15, wherein said grid wires are equally spaced apart along their entire length.

17. Apparatus as defined in claim 16, wherein the probe points are in a common plane and said grid wires are in a common plane parallel to the probe points' common plane.

18. Apparatus as defined in claim 17, wherein the common planes are flat.

19. Apparatus as defined in claim 18, wherein the probe points are connected to the negative side of the source and the grid wires are connected to the positive side of the source.

20. Apparatus as defined in claim 19, wherein the target is connected to the positive side of the source.

21. The method of effecting energy transfer to a target which comprises the step of arranging a plurality of electrically conductive points in facing relationship to the target, disposing electrically conductive grid wires between said points and target, electrically insulating the points from the grid wires, and connecting a high voltage low amperage direct current source across the points and grid wires.

22. The method of claim 21, which includes the further step of connecting the target to the same side of the source as the grid wires.

23. The method of claim 22, wherein the step of connecting the source to the points includes connecting the negative side of the source to the points.

24. The method of claim 23, wherein the step of disposing the grid wires includes equally spacing the wires from the points.

25. The method of claim 23, wherein the step of arranging the points includes arranging the points in a common plane, and the step of disposing said grid wires includes arranging the wires in a common plane parallel to the plane of the points.

26. Apparatus for effecting electrostatic transfer of energy to a target comprising, a probe of electrically conductive material having a pointed end, at least two spaced apart grid wires of electrically conductive material in spaced relation to said probe pointed end and electrically insulated therefrom, said wires being arranged symmetrically to the probe pointed end and of equal spacing therefrom and disposed between said probe pointed end and the target, means for supporting said probe and wires in electrically insulated relationship from each other, and a source of high voltage low amperage direct current connected across the probe and wires.

27. Apparatus as defined in claim 26, wherein said grid wires are a pair and extend parallel to each other.

28. Apparatus as defined in claim 27, wherein the probe is connected to the negative side of the voltage source.

29. Apparatus for effecting electrostatic transfer of energy to a target or targets comprising, a frame of rigid material adapted to be in spaced relationship to the target, a probe bar of rigid material mounted on the frame so that the bar can expand and contract independent of one another and the frame, a probe strip of electrically conductive material having at least one point therealong facing the target, said strip being supported by said probe bar so that the strip can expand and contract independent of said bar, at least two grid wires in precisely spaced relation with said probe strip and being disposed between the probe strip and the target, said grid wires being supported by the frame so that the wires can expand and contract independent of each other and the frame, means electrically insulating said probe strip from said grid wires, and a source of high voltage low amperage direct current connected across the probe strip and grid wires.

30. Apparatus as defined in claim 29, wherein said grid wires are equally spaced from the probe point.

31. Apparatus as defined in claim 30, wherein said grid wires are equally spaced apart along their entire length.

32. Apparatus as defined in claim 31, wherein the probe point is connected to the negative side of the source and the grid wires are connected to the positive side of the source.

* * * * *